US005437064A

United States Patent [19]

Hamaguchi

[11] Patent Number: 5,437,064

[45] Date of Patent: Aug. 1, 1995

[54] PROTECTIVE CAP APPARATUS

[76] Inventor: Melvin M. Hamaguchi, 5553 A Pia St., Honolulu, Hi. 96821

[21] Appl. No.: 177,776

[22] Filed: Feb. 22, 1994

[51] Int. Cl.[6] ..... A42B 1/06

[52] U.S. Cl. ..... 2/414; 2/421; 2/195.1; 2/909

[58] Field of Search ..... 2/410, 411, 412, 414, 2/417, 418, 421, 422, 424, 425, 205, 175.1, 195.1, 909, 918, 209.13, 181, 181.2, 181.4

[56] References Cited

U.S. PATENT DOCUMENTS

| | | | |
|---|---|---|---|
| D. 297,982 | 10/1988 | Coates . | |
| D. 311,088 | 10/1990 | Vargo . | |
| 2,717,384 | 9/1955 | Frothingham | 2/414 |
| 2,763,005 | 9/1956 | Richter | 2/414 |
| 3,478,365 | 11/1969 | Varga | 2/424 |
| 3,577,567 | 5/1971 | Holt | 2/414 |
| 4,011,600 | 3/1977 | Malk . | |
| 4,274,157 | 6/1981 | Boden . | |
| 4,581,773 | 4/1986 | Cunnane . | |
| 4,706,305 | 11/1987 | Cho | 2/424 |
| 5,226,180 | 7/1993 | Leach | 2/425 |
| 5,337,420 | 8/1994 | Haysom et al. | 2/425 |

FOREIGN PATENT DOCUMENTS

| | | | |
|---|---|---|---|
| 286726 | 10/1988 | European Pat. Off. | 2/411 |
| 2202729 | 10/1988 | United Kingdom | 2/411 |

*Primary Examiner*—Clifford D. Crowder

*Assistant Examiner*—Michael A. Neas

[57] ABSTRACT

A new and improved protective cap apparatus includes a first padding assembly which is adapted to fit onto a person's head, especially a child's. The first padding assembly includes a circular padding band adapted to fit circumferentially around a person's head in a horizontal orientation. The first padding assembly includes a plurality of semi-circular padding bands. Each respective semi-circular padding band includes a respective end portion which is connected to the circular padding band, such that each semi-circular padding band extends diametrically across the circular padding band forming a vertically oriented semi-circular arch. The respective semi-circular padding bands arc oriented with respect to each other such that the semi-circular padding bands overlap each other at a ninety degree angle. The circular padding band includes a stretchable portion which is capable of stretching to accommodate the first padding assembly to a variety of sizes of persons heads. A hemispherically-shaped second padded assembly adapted to placed under the first padding assembly. An outer hat assembly is provided which includes a plurality of fasteners which are placed in registration with respective fasteners on the first padding assembly when the outer hat assembly is placed on the first padding assembly. A chin strap assembly is provided to be worn in conjunction with the outer hat assembly.

3 Claims, 3 Drawing Sheets

PROTECTIVE CAP APPARATUS

BACKGROUND OF THE INVENTION

1. Field of the Invention

The present invention relates generally to head coverings or caps and, more particularly, to caps especially adapted for protecting the heads of toddlers when they fall.

2. Description of the Prior Art

When babies are first learning to walk, and even after they enter the toddler stage, the babies or toddlers are very susceptible to falling down. In falling down, there is always a danger of hitting one's head and sustaining a head injury. In this respect, it would be desirable if a device were provided that could be readily worn by babies or toddlers to prevent head injuries.

Throughout the years, a number of innovations have been developed relating to protecting babies' head from injury. One such innovation is a helmet. One disadvantage of a helmet is that a helmet is generally made from an nonporous material. As a result, the head cannot be readily ventilated, and perspiration tends to be a common result. To avoid excessive perspiration, it would be desirable if a protective head covering for babies and toddlers were well ventilated.

Nowadays, protection of a baby's head involves more than protection from physical trauma. With less ozone present in the stratosphere, there is more need to protect eyes and skin from unwanted UV radiation. In this respect, it would be desirable if a protective device for a baby's head were provided which shields the eyes and portions of the baby's skin from unwanted solar radiation.

Outdoors unwanted solar radiation is a problem. Indoors, however, unwanted solar radiation is not a problem, but the risk of physical trauma is still present. Hard-surface floors and furniture can be a source of trauma to the head if a baby falls while indoors. In this respect, it would be desirable if a protective device for a baby's head were provided which protected the baby from head trauma while indoors.

Since it is not necessary that head protection include protection from solar radiation when the baby is indoors, it would be desirable if a head protective device that is used indoors not be encumbered by devices to protect the baby from solar radiation.

When the baby goes outdoors, however, it would be desirable if the head protective device that is used indoors be left on rather than removing it and replacing it with another protective device. In this respect, for a protective device that is used outdoors, it would be desirable if an outdoor protective device could be placed over the indoor protective device.

Not only should the outdoor protective device be able to be placed over the indoor protective device, but the outdoor protective device should become attached to the indoor protective device. This assures that the two devices will not separate if the baby's head undergoes a physical trauma.

Babies grow very rapidly, and they have a tendency to outgrow headgear rapidly. In this respect, it would be desirable if a protective device for a baby's head were provided that is elastic to stretch to accommodate a baby's growing head.

When a hat is worn as a protective head covering to protect against physical head trauma when a baby falls, it is very important that the head covering remain on the head during and after the fall. If the head covering were to fall of the head, its protective value would be nullified. In this respect, it would be desirable if a protective device for a baby's head were provided that included a chin strap for assuring the head covering remains on the baby's head during and after a fall.

The dimensions of babies' heads vary quite a bit from one baby to another, and it would be desirable if a protective head covering were adjustable to fit a wide variety of babies' heads. In this respect, it would be desirable if a protective device for a baby's head were provided which included an adjustable chin strap for adjusting to a wide variety of sizes of babies' heads.

Aside from the protective innovations discussed above, the following U.S. patents are representative of some additional innovations in head coverings that have been developed over the years: U.S. Pat. Nos. 4,011,600; 4,274,157; 4,581,773; Des. 297,982; and Des. 311,088. It is noted that none of the devices disclosed in the above-cited patents provide a protective head covering that includes one mode for being worn indoors and another mode for being worn outdoors.

Thus, while the foregoing body of prior art indicates it to be well known to use protective head coverings for babies, the prior art described above does not teach or suggest a protective cap apparatus which has the following combination of desirable features: (1) can be readily worn by babies or toddlers to prevent head injuries; (2) is well ventilated; (3) shields the eyes and portions of the baby's skin from unwanted solar radiation; (4) protects the baby from head trauma while indoors; (5) is not encumbered by devices to protect the baby from solar radiation when worn indoors; (6) includes an outdoor protective device that can be placed over the indoor protective device; (7) provides for the outdoor protective device to become attached to the indoor protective device; (8) is elastic to stretch to accommodate a baby's growing head; (9) includes a chin strap for assuring the head covering remains on the baby's head during and after a fall; and (10) includes an adjustable chin strap for adjusting to a wide variety of sizes of babies' heads. The :foregoing desired characteristics are provided by the unique protective cap apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a new and improved protective cap apparatus which includes a first padding assembly which is adapted to fit onto a person's head, especially a child's. The first padding assembly includes a circular padding band adapted to fit circumferentially around a person's head in a horizontal orientation. The first padding assembly includes a plurality of semi-circular padding bands. Each respective semi-circular padding band includes a respective end portion which is connected to the circular padding band, such that each semi-circular padding band extends diametrically across the circular padding band forming a vertically oriented semi-circular arch.

A first fastener is connected to one of the semi-circular padding bands. The first fastener faces outward from the semi-circular padding band. A plurality of second fasteners are connected to the circular padding band.

The second fasteners face outward from the circular padding band. The first fastener and the second fasteners are made from a hook or loop fastener material. The respective semi-circular padding bands are oriented with respect to each other such that the semi-circular padding bands overlap each other at a ninety degree angle.

The circular padding band includes a stretchable portion which is capable of stretching to accommodate the first padding assembly to a variety of sizes of persons heads.

A hemispherically-shaped second padded assembly adapted to placed under the first padding assembly. The second padded assembly includes an outer fabric layer and an inner quantity of resilient foam housed within the outer fabric layer.

An outer hat assembly includes a hemispherical head-covering portion and a visor portion attached to the head-covering portion. The head-covering portion includes an interior surface. A plurality of third fasteners are connected to the interior surface of the head-covering portion. The third fasteners are located on the interior surface of the head-covering portion such that the third fasteners on the interior surface are placed in registration with the respective first fastener and the second fasteners when the outer hat assembly is placed on the first padding assembly. The third fasteners are complimentary to the respective first fastener and the second fasteners.

Fourth fasteners are connected to the circular padding band. The fourth fasteners face outward from the circular padding band. A chin strap assembly includes a strap member and a plurality of fifth fasteners located at respective ends of the strap member. The fifth fasteners are complementary to the fourth fasteners for attaching the chin strap assembly to the first padding assembly.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining at least four preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

It is therefore an object of the present invention to provide a new and improved protective cap apparatus which has all of the advantages of the prior art and none of the disadvantages.

It is another object of the present invention to provide a new and improved protective cap apparatus which may be easily and efficiently manufactured and marketed.

It is a further object of the present invention to provide a new and improved protective cap apparatus which is of durable and reliable construction.

An even further object of the present invention is to provide a new and improved protective cap apparatus which is susceptible of a low cost of manufacture with regard to both materials and labor, and which accordingly is then susceptible of low prices of sale to the consuming public, thereby making such protective cap apparatus available to the buying public.

Still yet a further object of the present invention is to provide a new and improved protective cap apparatus which can be readily worn by babies or toddlers to prevent head injuries.

Still another object of the present invention is to provide a new and improved protective cap apparatus that is well ventilated.

Yet another object of the present invention is to provide a new and improved protective cap apparatus which shields the eyes and portions of the baby's skin from unwanted solar radiation.

Even another object of the present invention is to provide a new and improved protective cap apparatus that protects the baby from head trauma while indoors.

Still a further object of the present invention is to provide a new and improved protective cap apparatus which is not encumbered by devices to protect the baby from solar radiation when worn indoors.

Yet another object of the present invention is to provide a new and improved protective cap apparatus that includes an outdoor protective device that can be placed over the indoor protective device.

Still another object of the present invention is to provide a new and improved protective cap apparatus which provides for the outdoor protective device to become attached to the indoor protective device.

Yet another object of the present invention is to provide a new and improved protective cap apparatus that is elastic to stretch to accommodate a baby's growing head.

Still a further object of the present invention is to provide a new and improved protective cap apparatus that includes a chin strap for assuring the head covering remains on the baby's head during and after a fall.

Yet another object of the present invention is to provide a new and improved protective cap apparatus which includes an adjustable chin strap for adjusting to a wide variety of sizes of babies' heads.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein.

DESCRIPTION OF THE PREFERRED EMBODIMENT

With reference to the drawings, a new and improved protective cap apparatus embodying the principles and concepts of the present invention will be described.

Figure 1:
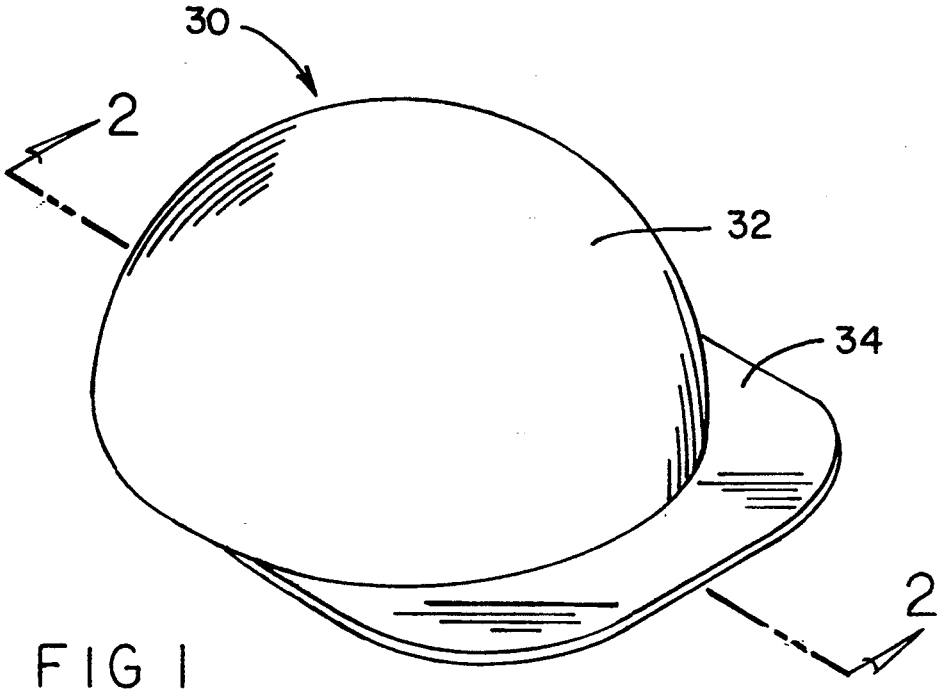
FIG. 1 is a perspective view showing a first preferred embodiment of a visor-containing hat portion of the protective cap apparatus of the invention.
Figure 2:
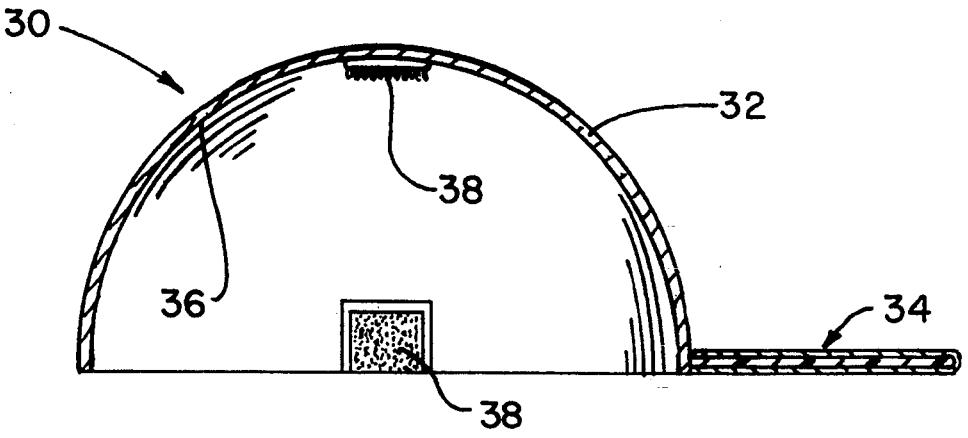
FIG. 2 is a cross-sectional view of the visor-containing hat portion of the protective cap apparatus of the invention taken along line 2—2 of FIG. 1.
Figure 3:
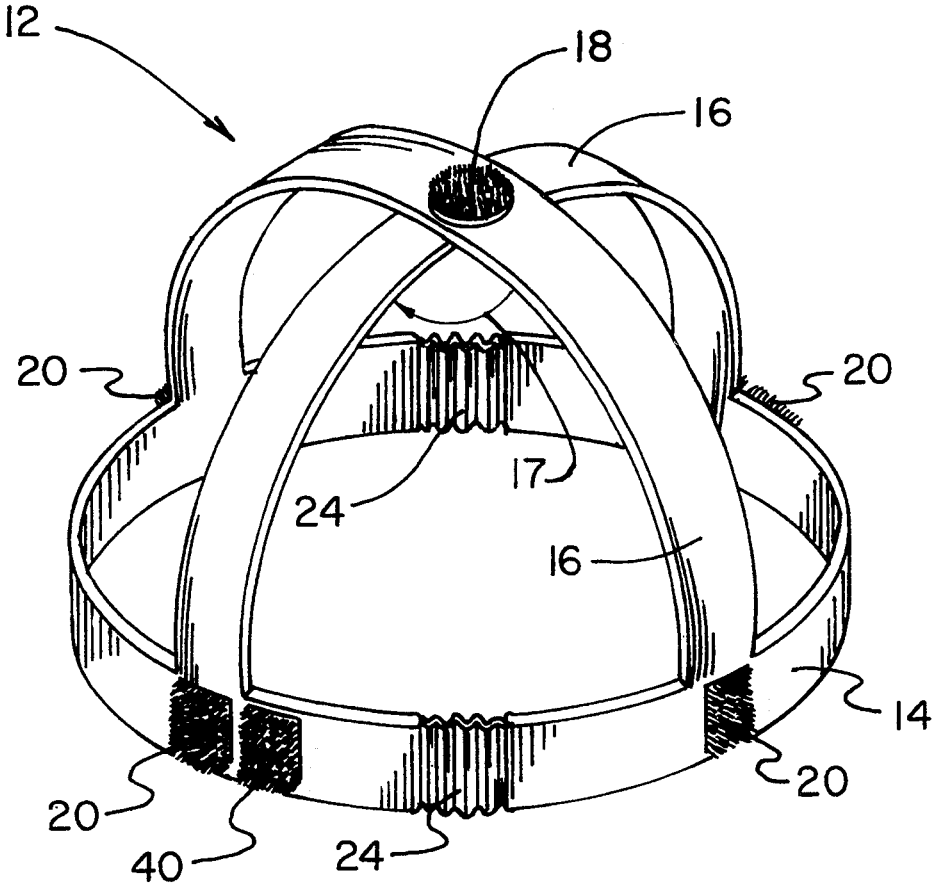
FIG. 3 is a perspective view of an embodiment of a first padding assembly of the protective cap apparatus of the invention which is used with the visor-containing hat portion shown in FIGS. 1 and 2.

Turning initially to FIGS. 1–3, there is shown a first exemplary embodiment of the protective cap apparatus of the invention generally designated by reference numeral 10. In its preferred form, protective cap apparatus 10 includes a first padding assembly 12 (see FIG. 3) which is adapted to fit onto a person's head, especially a child's. The first padding assembly 12 includes a circular padding band 14 adapted to fit circumferentially around a person's head in a horizontal orientation. The first padding assembly 12 includes a plurality of semi-circular padding bands 16. Each respective semi-circular padding band 16 includes a respective end portion which is connected to the circular padding band 14, such that each semi-circular padding band 16 extends diametrically across the circular padding band 14 forming a vertically oriented semi-circular arch.

A first fastener 18 is connected to one of the semi-circular padding bands 16. The first fastener 18 faces outward from the semi-circular padding band 16. A plurality of second fasteners 20 are connected to the circular padding band 14. The second fasteners 20 face outward from the circular padding band 14. The first fastener 18 and the second fasteners 20 are made from a hook or loop fastener material such as a hook or loop portion of Velcro(TM) material. The respective semi-circular padding bands 16 are oriented with respect to each other such that the semi-circular padding bands 16 overlap each other at a ninety degree angle 17.

The circular padding band 14 includes a stretchable portion 24 which is capable of stretching to accommodate the first padding assembly 12 to a variety of sizes of persons heads. The first padding assembly 12 of the invention is especially useful for protecting a baby's or toddler's head from physical trauma, both indoors and outdoors. A number of sizes can be made for different aged children.

Figure 4:
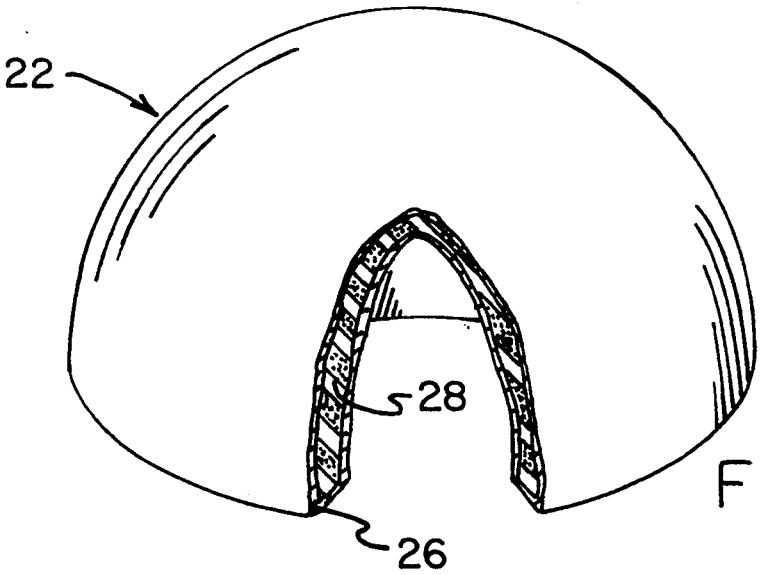
FIG. 4 is a perspective view of a partially broken away liner assembly that can be worn in conjunction with the first padding assembly of the invention shown in FIG. 3 to form a second embodiment of the invention.

Providing a second embodiment of the invention, reference is made to FIG. 4 which discloses hemispherically-shaped second padded assembly 22 adapted to placed under the first padding assembly 12. When the second padded assembly 22 is placed under the first padding assembly 12, then the second padded assembly 22 contacts the head of the wearer. The second padded assembly 22 includes an outer fabric layer 26 and an inner quantity of resilient foam 28 housed within the outer fabric layer 26.

As shown in FIGS. 1 and 2, outer hat assembly 30 includes a hemispherical head-covering portion 32 and a visor portion 34 attached to the head-covering portion 32. The head-covering portion 32 includes an interior surface 36. A plurality of third fasteners 38 are connected to the interior surface 36 of the head-covering portion 32. The third fasteners 38 are located on the interior surface 36 of the head-covering portion 32 such that the third fasteners 38 on the interior surface 36 are placed in registration with the respective first fastener 18 and the second fasteners 20 when the outer hat assembly 30 is placed on the first padding assembly 12. The third fasteners 38 are complimentary to the respective first fastener 18 and the second fasteners 20. A preferred characteristic of the outer hat assembly 30 is that it be made of a woven fabric that permits ventilation of the hat.

Figure 5:
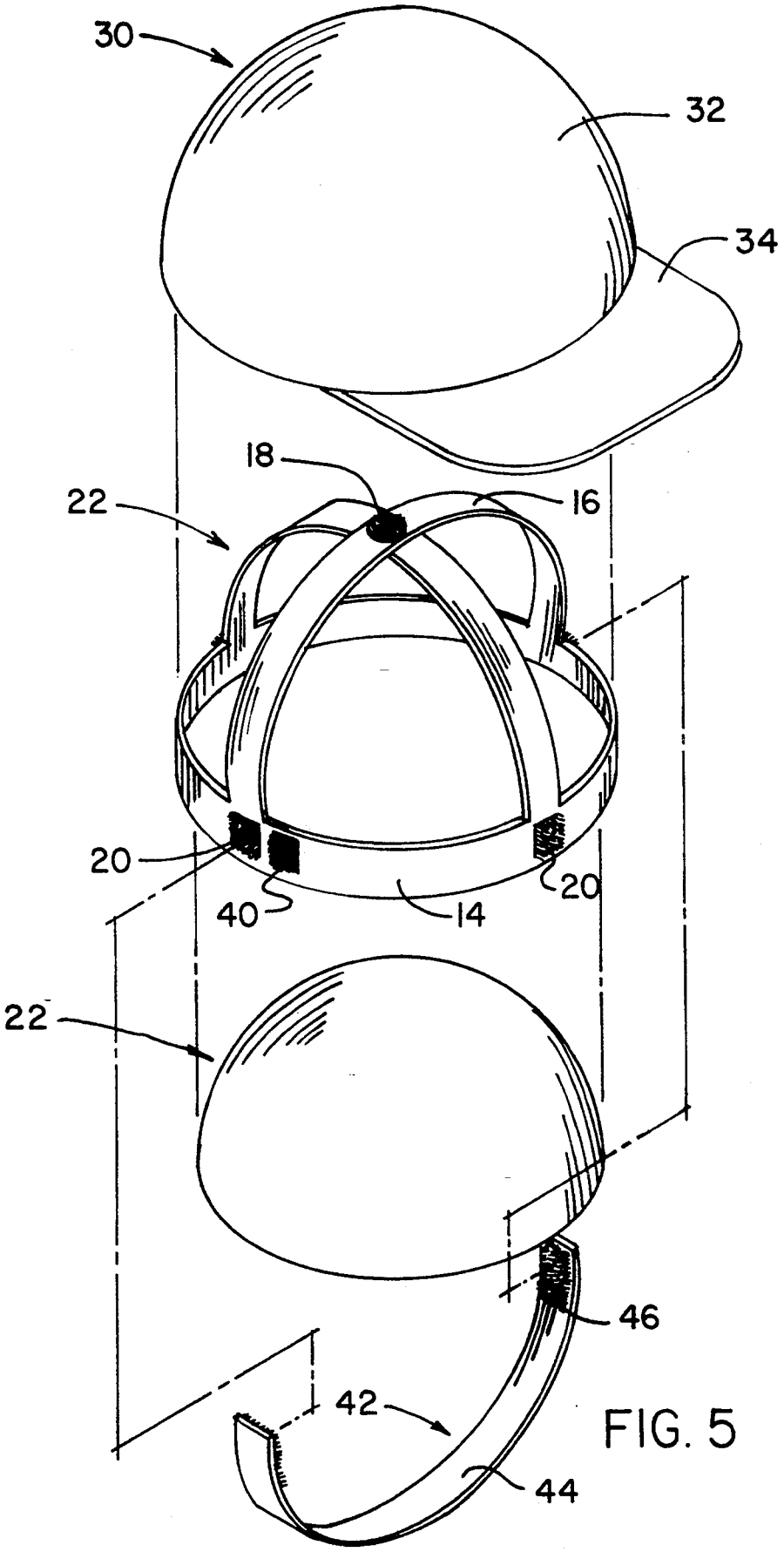
FIG. 5 is an exploded perspective view of a third embodiment of the protective cap apparatus of the invention which includes a chin strap.

Fourth fasteners 40 are connected to the circular padding band 14. The fourth fasteners 40 face outward from the circular padding band 14. In accordance with a third embodiment of the invention shown in FIG. 5, a chin strap assembly 42 includes a strap member 44 and a plurality of fifth fasteners 46 located at respective ends of the strap member 44. The fifth fasteners 46 are complementary to the fourth fasteners 40 for attaching the chin strap assembly 42 to the first padding assembly 12.

All of the fasteners described above can be made from respective hook or complementary loop portions of Velcro( TM ) material.

The components of the protective cap apparatus of the invention can be made from inexpensive and durable fabric and plastic materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved protective cap apparatus that is low in cost, relatively simple in design and operation, and which may advantageously be worn by babies or toddlers to prevent head injuries. With the invention, a protective cap apparatus is provided which is well ventilated. With the invention, a protective cap apparatus is provided which shields the eyes and portions of the baby's skin from unwanted solar radiation. With the invention, a protective cap apparatus is provided which protects the baby from head trauma while indoors. With the invention, a protective cap apparatus is provided which is not encumbered by devices to protect the baby from solar radiation when worn indoors. With the invention, a protective cap apparatus is provided which includes an outdoor protective device that can be placed over the indoor protective device. With the invention, a protective cap apparatus is provided which provides for the outdoor protective device to become attached to the indoor protective device. With the invention, a protective cap apparatus is provided which is elastic to stretch to accommodate a baby's growing head. With the invention, a protective cap apparatus is provided which includes a chin strap for assuring the head covering remains on the baby's head during and after a fall. With the invention, a protective cap apparatus is provided which includes an adjustable chin strap for adjusting to a wide variety of sizes of babies' heads.

With respect to the above description, it should be realized that the optimum dimensional relationships for the parts of the invention, to include variations in size, form function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiments of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed as being new and desired to be protected by Letters Patent of the United States is as follows:

1. A protective cap apparatus, comprising:

a first padding assembly adapted to fit onto a person's head, said first padding assembly including a circular padding band adapted to fit circumferentially around a person's head in a horizontal orientation, said first padding assembly including a plurality of semi-circular padding bands, wherein each respective semi-circular padding band includes a respective end portion connected to said circular padding band, such that each semi-circular padding band extends diametrically across said circular padding band forming a vertically oriented semi-circular arch, a first fastener connected to one of said semi-circular padding bands, said first fastener facing outward from said semi-circular padding band, a plurality of second fasteners connected to said circular padding band, said second fasteners facing outward from said circular padding band, an outer hat assembly which includes a hemispherical head-covering portion and a visor portion attached to said head-covering portion, wherein said head-covering portion includes an interior surface, a plurality of third fasteners connected to said interior surface of said head-covering portion, said third fasteners being located on said interior surface of said head-covering portion such that said third fasteners are placed in registration with said respective first fastener and said second fasteners when said outer hat assembly is placed on said first padding assembly, wherein said third fasteners are complimentary to said respective first fastener and said second fasteners, fourth fasteners connected to said circular padding band, said fourth fasteners facing outward from said circular padding band, and a chin strap assembly which includes a strap member and a plurality of fifth fasteners located at respective ends of said strap member, wherein said fifth fasteners are complementary to said fourth fasteners for attaching said chin strap assembly to said first padding assembly, wherein said first fastener, said second fasteners, said third fasteners, said fourth fasteners, and said fifth fasteners are made from hook or loop fastener materials.

2. The apparatus described in claim 1 wherein said respective semi-circular padding bands are oriented with respect to each other such that said semi-circular padding bands overlap each other at a ninety degree angle.

3. The apparatus described in claim 1 wherein said circular padding band includes a stretchable portion which is capable of stretching to accommodate said first padding assembly to a variety of sizes of persons heads.

* * * * *